US006412446B1

(12) United States Patent
Johnsen

(10) Patent No.: US 6,412,446 B1
(45) Date of Patent: Jul. 2, 2002

(54) METHOD OF FIRING IN A BOILER AND A BOILER FOR USING THE METHOD

(75) Inventor: Jørgen Bøgild Johnsen, Søborg (DK)

(73) Assignee: FLS miljo a/s, Valby (DK)

( * ) Notice: Subject to any disclaimer, the term of this patent is extended or adjusted under 35 U.S.C. 154(b) by 0 days.

(21) Appl. No.: 09/743,341

(22) PCT Filed: Jul. 12, 1999

(86) PCT No.: PCT/DK99/00395

§ 371 (c)(1),
(2), (4) Date: Jun. 9, 2000

(87) PCT Pub. No.: WO00/03179

PCT Pub. Date: Jan. 20, 2000

(30) Foreign Application Priority Data

Jul. 10, 1998 (DK) ..... 1998 00920

(51) Int. Cl.[7] ..... B09B 3/00
(52) U.S. Cl. ..... 122/2; 122/4 R; 110/234
(58) Field of Search ..... 122/2, 4 R, 4 C; 110/234, 108, 109, 267, 281, 289, 290, 291

(56) References Cited

U.S. PATENT DOCUMENTS 3,393,652 A * 7/1968 Connell ..... 110/234
4,213,405 A 7/1980 Lis et al.
4,263,857 A 4/1981 Ban
4,838,183 A * 6/1989 Tsaveras et al. ..... 110/190
4,932,336 A * 6/1990 Srowig et al. ..... 110/346
5,052,310 A * 10/1991 Goff et al. ..... 110/234
5,241,916 A 9/1993 Martin
5,762,008 A 6/1998 Martin et al.

FOREIGN PATENT DOCUMENTS

EP 0754907 1/1997

* cited by examiner

*Primary Examiner*—Jiping Lu
(74) *Attorney, Agent, or Firm*—Venable; John P. Shannon; Chad C. Anderson

(57) ABSTRACT

Loosely stacked fuel (6) is introduced through a charging opening (5) into the furnace (1) of the boiler on a first support (7), and jets (25) of ignition air entraining hot flue gas from the furnace are directed at the surface of the fuel on the support so that the surface layer is ignited and the fuel is partially gasified. The fuel is passed onto a grate (9) located at a lower level on for final combustion. The air from the ignition air jets (25) are permitted, together with the entrained flue gas, to pass down through the loosely stacked fuel (6) and the first support (7) and then to flow off to the furnace (1). The flue gas entrained by the ignition air jets (25) is drawn substantially from a section of the furnace through which flows a mixture of combustion products from the first support and the grate.

18 Claims, 1 Drawing Sheet

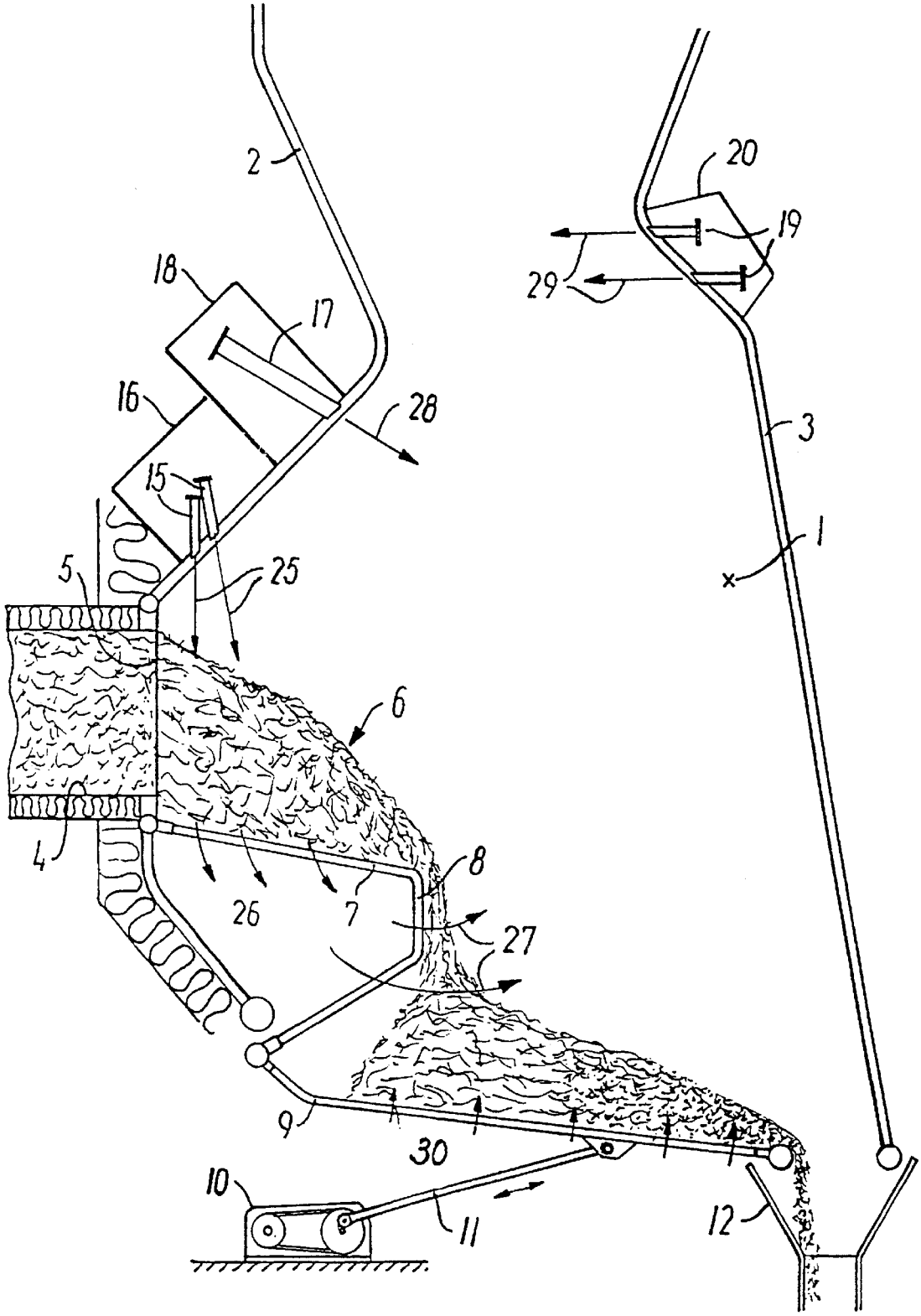
2
20
19
29
18
17
16
28
3
15
1
5
25
6
4
8
26
7
27
9
30
10
11
12

METHOD OF FIRING IN A BOILER AND A BOILER FOR USING THE METHOD

BACKGROUND OF THE INVENTION

The present invention relates to a method of firing in a boiler, in which method loosely stacked fuel is introduced through a charging opening into the furnace of the boiler on a first support, and jets of ignition air entraining hot flue gas from the furnace are directed at the surface of the loosely stacked fuel on the support so that the surface layer of the loosely stacked fuel is ignited and the fuel is partially gasified, whereupon the fuel is passed on to a grate located at a lower level on which the final combustion of the fuel takes place. The present invention also relates to a boiler for using the method.

In prior-art boilers, the area of the furnace at the charging opening is formed so as to be relatively closed, being defined upwards by a slightly inclined portion of the wall above the charging opening with inserted ignition air nozzles and downwards by a fixed bottom inclined at an angle of less than 5° to 20°. This prior-art structure is designed to allow control of the supply of oxygen and thus the possible release of energy for expulsion of gases from the loosely stacked fuel on the fixed bottom. It has proved, however, that it is difficult to obtain a stable rate of combustion because the combustion can vary strongly at relatively small variations of the air permeability and humidity content of the loosely stacked fuel and the rate at which the fuel is charged into the furnace.

It is a further disadvantage of the prior-art boiler with a fixed bottom that deposits of melted or sintered ash particles can accumulate partly on the boiler wall in the area around the ignition air nozzles, partly on the first support. To ensure the free passage of the fuel it is necessary to remove such deposits at regular intervals, which may cause undesirable stop-pages. Prior art also suffers from the defect that the combustion develops a not inconsiderable amount of nitrogen oxide (NO), which is emitted to the surroundings and pollutes the environment via the chimney of the boiler plant.

U.S. patent publication Ser. No. 4,213,405 describes a boiler for combustion of solid fuel, such as wood waste, in which the furnace of the boiler has a first support in the form of an inclined grate the main purpose of which is to dry the fuel, the flue gases from the combustion zones above a second grate located at a lower level being conducted to and passing up through a top zone of the first grate.

BRIEF SUMMARY OF THE INVENTION

The object of the present invention is to provide a method which reduces or eliminates the above problems. This is obtained in accordance with the invention by a method of the type mentioned in the introduction and characterized in that the air from the ignition air jets are permitted, together with the entrained flue gas, to pass down through the loosely stacked fuel and the first support and then to flow off to the furnace, and that the flue gas entrained by the ignition air jets is drawn substantially from a section of the furnace through which flows a mixture of combustion products from the first support and the grate.

By means of the method, the air from the ignition air nozzles together with the entrained flue gas passes through the fuel to the first support, in the following called the first grate, and then t through the grate to the lower side thereof. The result of this is that the gases developed by ignition of the surface layer of the fuel and the gasification of the underlying part of the fuel are passed on down through the fuel to the lower side of the first grate. The combustion gases flow from here out into the furnace and thus pass above the combusting fuel located on the second, lower grate, whereby the combustion gases from the two grates are mixed while being mixed with primary and secondary air supplied to the furnace in a conventional manner. Part of this mixture of flue gases is then drawn in by the ignition air jets from the furnace towards the surface of the fuel on the first support.

Surprisingly, this method has turned out to provide extremely stable combustion, and the rate of combustion can easily be controlled regardless of any variations of the air permeability or humidity content of the loosely stacked fuel or its feeding rate.

It has furthermore proved that the method according to the invention results in substantially smaller amounts of melted or sintered ash particles, and a not inconsiderable reduction of the amount of nitrogen oxide produced by the combustion is seen.

Finally, it can be mentioned that no backfire of the combustion to the charging channel occurs in the boiler according to the invention, as is the case in the prior-art boiler.

It is assumed that these good results are due, mainly, to the fact that the mixture of air and flue gas that hits the surface of the loosely stacked fuel together with the gasification products from the loosely stacked fuel is passed down below the first grate. This ensures that hot flue gas from the furnace can flow into the area around the ignition air nozzles, that a large proportion of this flue gas is recirculated through the loosely stacked fuel, and that the gases around the surfaces of the first grate have a relatively homogeneous and low temperature. This must be seen in relation to the prior-art boiler, in which the ignition air jets are unable to penetrate the fuel bed as the bottom under the fuel bed is not open to penetration. This means that the products developed by the gasification, which are relatively cold compared with the flue gas in the middle of the furnace, escape from the upper surface of the loosely stacked fuel substantially to the area around the ignition air nozzles and thus limit the flow of hot flue gas to this area. This fact is further supported in the prior-art boiler by the wall above the charging opening being formed with a near-horizontal inclination, thus preventing the flow of flue gas from the middle of the furnace.

The prior-art boiler with a fixed bottom has no well-defined flow pattern at the surface of the fixed bottom. This allows the hot gas flow from the ignition air nozzles to follow randomly occurring holes in the fuel bed and to hit the fixed bottom, whereby partially melted particles of ash suspended in the hot flue gas can be deposited on the bottom. This is avoided to a substantial extent in the method according to the invention, partly because such flows seek towards the openings in the underlying first grate and thus do not deposit particles on the grate surface, partly because the remaining part of the grate surface supporting the overlying fuel is protected by the fuel to a higher degree.

The prior-art boiler with a fixed bottom has a large excess of combustible gases and thus a deficit of oxygen in the area around the ignition air nozzles. Consequently, the amount of air and thus of oxygen supplied to the area around the ignition air nozzles has a crucial influence on the rate at which the gasification products are expelled from the fuel on the fixed bottom, as the supply of air to the area around the ignition air nozzles will cause a strong temperature increase in the area under these conditions. As a substantial part of the gasification of the fuel on the fixed bottom typically occurs at temperatures below 500° C., whereas oxidation of these gasification products requires temperatures above 800–1,000° C., a careful balancing of the relationship between the amount of air supplied to the flue gas at the area around the ignition air nozzles and the degree of heat transfer between flue gas and fuel on the fixed bottom is required. In case of excessive heat transfer, the temperature of the flue gas at the ignition air nozzles will drop, whereby the reaction between combustible components of the flue gas and oxygen supplied by the air will cease. In case of an insufficient heat transfer the temperature in the flue gas entrained by the ignition air jets will rise to a level where ash particles suspended in the flue gas will melt and where ash formed in the surface of the fuel bed will melt and thus further inhibit the heat transfer between flue gas and fuel. To control these conditions, the ignition air nozzles in the prior-art boiler are arranged in a relatively closed area of the furnace.

The method according to the invention avoids these problems because flue gas in which most of the combustible products are oxidized is drawn for the ignition air nozzles. As a substantial part of the chemically bound energy has already been transformed into heat in the flue gas before the latter is mixed with the ignition air, the temperature will thus always be sufficient to ensure continued oxidation in the flue gas during the mixing itself. The reduced amount of combustible gases in the flue gas around the ignition air nozzles also means that there is more oxygen present in the mixture of ignition air and flue gas so that the amount of air supplied with and around the ignition air jets does not have the same decisive influence on the latters' temperature as in the prior art described. This makes it possible for the amount of ignition air supplied in the ignition air jets to be varied considerable more freely, exclusively for the purpose of obtaining the desired rate of combustion on the first grate.

A further effect of the excess of oxygen mentioned above in and around the ignition air jets in combination with the flow through the fuel bed according to the invention is that the nitrogen compounds contained in the flue gas at the ignition air nozzles and deriving from the fuel will be oxidized in the ignition air jets and be able to react with non-oxidized nitrogen compounds in the gasification products with formation of free nitrogen, which is not to any substantial degree oxidized into nitrogen oxide in the furnace. This results in a substantial reduction of the total production of nitrogen oxide at the combustion. It is assumed that the formation of free nitrogen is promoted by the increased presence of free radicals, as will be described below.

To efficiently avoid the melting of ash particles suspended in the flue gas and their fastening on the walls of the boiler around the ignition air nozzles it is necessary to restrict the temperature in this area to 900–1,100° C. However, the method according to the invention permits a temperature in the ignition air jets themselves which is higher than the above level because according to the method, the ignition air jets pass through the first support contrary to the ignition air, which is "thrown back" in the prior-art boiler and thus hits the area around the ignition air nozzles.

In the method according to the invention, the ignition air and entrained flue gas will be cooled at the passage of the fuel bed as a consequence of the mixing with gasification products.

The above higher temperature permitted in the ignition air jets according to the invention contributes to efficient decomposition of the tar substances in the gasification products. It is assumed that the decomposition of tar substances is further promoted if CO and $H_2$ are combusted immediately before the flue gases entrained by the ignition air jets meet the fuel bed, as the following rapid chain reactions will occur:

$$H_2+OH \rightarrow H_2O+H$$

$$CO+OH \rightarrow CO_2+H$$

$$O_2+H \rightarrow O+OH$$

$$O+H_2O \rightarrow 2OH$$

resulting in the following net reactions:

$$H_2+O_2 \rightarrow 2OH$$

$$CO+O_2+H_2O \rightarrow CO_2+2OH$$

The free OH radicals so formed can react with the tar substances and contribute to their decomposition. Alternatively, they will disintegrate through, for example, the following reactions:

$$CO+OH \rightarrow CO_2+H$$

$$OH+H \rightarrow H_2O$$

resulting net in the following reaction:

$$CO+2OH \rightarrow CO_2+H_2O.$$

It must then be assumed that the decomposition of tar substances is promoted if the flue gas drawn in towards the ignition air nozzles from the furnace contains considerable amounts of CO and $H_2$. Under the normal conditions in a furnace where the flue gas may be considerably inhomogeneous, this will be the fact if the flue gas, before it is entrained by the ignition air, is supplied with 60–110 per cent, preferably 70–100 per cent, especially 80–90 per cent, of the amount of air stoichiometrically required for combustion of the fuel. These mixing ratios are correspondingly assumed to be nearly optimum to obtain the reduction of the formation of nitrogen oxide described above.

In the boiler according to the invention, these mixing ratios can be maintained by tertiary air nozzles being placed in at least one of the boiler walls at a level with or above a narrowing of the flow cross-section of the furnace formed by the inclined wall above the charging opening. The tertiary air is necessary to ensure that the flue gas coming from the furnace below the narrowing is supplied with so much oxygen that the flue gas can be completely combusted before it is passed on to the convection part of the boiler. The location mentioned ensures that the tertiary air supplied is not mixed with the flue gas flowing in to the ignition air nozzles and thus changes the advantageous mixing ratios mentioned above.

The fact that the gasification products from the first grate are passed over and mixed with the combustion products from the second grate means partly that the gasification products cannot reach the ignition air jets in a pure form and thus, as a consequence of their content of tar substances, impede the oxidation of the jets, partly that the tar substances are further decomposed, as the combustion products from the second grate to a greater extent consist of CO, which decomposes the tar substances at co-combustion therewith, as already described.

In another embodiment of the method according to the invention, the combustion can be adjusted by increasing the ignition air amount when the oxygen content of the flue gas is high or is increasing and by reducing the ignition air amount when the oxygen content of the flue gas is low or is decreasing. This form of adjustment, known per se, has proved to become very stable when used in connection with the method according to the invention, as undesired influence from gasification products returning straight from the surface of the fuel bed to the ignition air jets has now been eliminated.

The present invention also relates to a boiler for using the method described above, the boiler comprising a furnace with a charging opening, a first support formed as a first grate with grate apertures, a grate located at a lower level, and ignition air nozzles located above the first support, which boiler is characterized in that said grate apertures constitute more than 20 percent, preferably more than 50 percent, especially more than 70 percent of the area of the first grate, that the ignition air nozzles are located in a wall of the boiler above the charging opening and are directed at the first grate, and that the wall above the charging opening is inclined upwards towards the middle of the furnace at an angle with horizontal of 20–70°, preferably 30–60°, especially 45°.

In the embodiment described, the design of the front wall inclined upwards ensures that the flue gas is drawn in from the particular section of the furnace located at the charging opening through which the desired mixture of flue gas from the two grates will flow.

Further embodiments are disclosed herein.

BRIEF DESCRIPTION OF THE INVENTION

The FIGURE shows one embodiment on the invention

DETAILED DESCRIPTION OF THE INVENTION

The invention will now be explained in more derail by means of an embodiment and with reference to the drawing, which shows a furnace 1 in a boiler according to the invention. The furnace 1 is defined by a front wall 2, through which fuel 6 is charged through a charging channel 4 and a charging opening 5 on a first grate 7 inclined downwards at an inclination of approximately 10°. In the furnace there is a second grate 9 located lower down and in this case formed as a shaker grate shaken by means of a vibrator mechanism. 10 connected with the grate by means of a rod 11.

The grate 7 is formed as a number of isolated tubes through which there is free passage. The tubes may typically have an outer diameter of 30–50 mm and a mutual distance of 100–300 mm. The second grate a is inserted under the first grate 7 for collecting ashes and any fuel falling through, and its water pipes are continued to the water pipes of the first grate 7, thus creating a flexible connection between the fixed grate 7 and the movable grate 9.

The portion of the front wall 2 above the charging opening 5 is inclined upwards at an angle of approximately 45°, and in the front wall ignition air nozzles 15 are inserted for directing air jets down at the loosely stacked fuel 6 on the grate, as indicated by arrows 25. The resulting flow of air and gases through the fuel is indicated by arrows 26 and 27. The ignition air is supplied through an ignition air channel 16. The fuel is supplied with primary air 30 through apertures in the shaker grate 9 and secondary air through secondary air nozzles 17, the direction of the air flow being indicated by the arrow 28. The secondary air is supplied via a secondary air channel 18.

The furnace of the boiler has a cross-section which narrows upwards and then expands again. At the narrowing, tertiary air nozzles 19 are arranged in the back wall 3 of the boiler and are supplied with air from a tertiary air channel 20. As indicated by arrows 29, the air flow from the tertiary air nozzles is directed at the front wall 2 above the narrowed area so that the tertiary air is not mixed with the flue gas drawn in to the ignition air nozzles.

What is claimed is:

1. A method of firing in a boiler, comprising:

introducing loosely stacked fuel (6) through a charging opening (5) into a furnace (1) of the boiler on a first support (7);

directing jets (25) of ignition air entraining hot flue gas from the furnace at a top surface of the loosely stacked fuel on the first support so that the top surface of the loosely stacked fuel is ignited and the fuel is partially gasified;

passing the air from the ignition air jets (25), together with the entrained flue gas, down through the loosely stacked fuel (6) and the first support (7) and to the furnace (1); and passing the fuel onto a grate (9) located at a lower level on which the final combustion of the fuel takes place, wherein the flue gas entrained by the ignition air jets (25) is drawn substantially from a section of the furnace through which flows a mixture of combustion products from the first support and the grate (9).

2. A method according to claim 1, characterized in that said section of the furnace (1) is located substantially at a level above the upper edge of the charging opening (5).

3. A method according to claim 1, characterized in that before the flue gas is entrained by the ignition air, the flue gas is provided with 60-110 percent of the volume of air stoichiometrically required for the combustion.

4. A method according to claim 1, characterized in that the combustion is adjusted by increasing the ignition air amount when the oxygen content of the flue gas is high or is increasing, and by reducing the ignition air amount when the oxygen content of the flue gas is low or is decreasing.

5. A method according to claim 1, characterized in that the fuel used is straw.

6. A method according to claim 1 characterized in that before the flue gas is entrained by the ignition air, the flue gas is provided with 70–100 percent of the volume of air stoichiometrically required for the combustion.

7. A method according to claim 1, characterized in that before the flue gas is entrained by the ignition air, the flue gas is provided with 80–90 percent of the volume of air stoichiometrically required for the combustion.

8. A boiler for using the method according to claim 1, comprising a furnace (1) having a charging opening (5), a first support (7) formed as a first grate (7) with grate apertures, a grate (9) located at a lower level, and ignition air nozzles (15) located above the first support, characterized in that said grate apertures constitute more than 20 percent of the area of the first grate (7), that the ignition air nozzles (15) are located in a wall (2) of the boiler above the charging opening (5) and are directed at the first grate (7), and that the wall (2) above the charging opening (5) is inclined upwards towards the middle of the furnace (1) at an angle with horizontal of 20–70°.

9. A boiler according to claim 8, characterized in that tertiary air nozzles (19) are arranged in at least one of the walls (3) of the boiler at a level with or above a narrowing of the flow cross-section of the furnace (1) formed by the inclined wall (2) above the charging opening (5).

10. A boiler according to claim 8, characterized in that the second grate (9) extends below at least part of the first grate (7).

11. A boiler for using the method according to claim 1, comprising a furnace (1) having a charging opening (5), a first support (7) formed as a first grate (7) with grate apertures, a grate (9) located at a lower level, and ignition air nozzles (15) located above the first support, characterized in that said grate apertures constitute more than 50 percent of the area of the first grate (7), that the ignition air nozzles (15) are located in a wall (2) of the boiler above the charging opening (5) and are directed at the first grate (7), and that the wall (2) above the charging opening (5) is inclined upwards towards the middle of the furnace (1) at an angle with horizontal of 20–70°.

12. A boiler for using the method according to claim 1, comprising a furnace (1) having a charging opening (5), a first support (7) formed as a first grate (7) with grate apertures, a grate (9) located at a lower level, and ignition air nozzles (15) located above the first support, characterized in that said grate apertures constitute more than 70 percent of the area of the first grate (7), that the ignition air nozzles (15) are located in a wall (2) of the boiler above the charging opening (5) and are directed at the first grate (7), and that the wall (2) above the charging opening (5) is inclined upwards towards the middle of the furnace (1) at an angle with horizontal of 20–70°.

13. A boiler for using the method according to claim 1, comprising a furnace (1) having a charging opening (5), a first support (7) formed as a first grate (7) with grate apertures, a grate (9) located at a lower level, and ignition air nozzles (15) located above the first support, characterized in that said grate apertures constitute more than 20 percent of the area of the first grate (7), that the ignition air nozzles (15) are located in a wall (2) of the boiler above the charging opening (5) and are directed at the first grate (7), and that the wall (2) above the charging opening (5) is inclined upwards towards the middle of the furnace (1) at an angle with horizontal of 30–60°.

14. A boiler for using the method according to claim 1, comprising a furnace (1) having a charging opening (5), a first support (7) formed as a first grate (7) with grate apertures, a grate (9) located at a lower level, and ignition air nozzles (15) located above the first support, characterized in that said grate apertures constitute more than 20 percent of the area of the first grate (7), that the ignition air nozzles (15) are located in a wall (2) of the boiler above the charging opening (5) and are directed at the first grate (7), and that the wall (2) above the charging opening (5) is inclined upwards towards the middle of the furnace (1) at an angle with horizontal of 45°.

15. A boiler for using the method according to claim 1, comprising a furnace (1) having a charging opening (5), a first support (7) formed as a first grate (7) with grate apertures, a grate (9) located at a lower level, and ignition air nozzles (15) located above the first support, characterized in that said grate apertures constitute more than 50 percent of the area of the first grate (7), that the ignition air nozzles (15) are located in a wall (2) of the boiler above the charging opening (5) and are directed at the first grate (7), and that the wall (2) above the charging opening (5) is inclined upwards towards the middle of the furnace (1) at an angle with horizontal of 30–60°.

16. A boiler for using the method according to claim 1, comprising a furnace (1) having a charging opening (5), a first support (7) formed as a first grate (7) with grate apertures, a grate (9) located at a lower level, and ignition air nozzles (15) located above the first support, characterized in that said grate apertures constitute more than 50 percent of the area of the first grate (7), that the ignition air nozzles (15) are located in a wall (2) of the boiler above the charging opening (5) and are directed at the first grate (7), and that the wall (2) above the charging opening (5) is inclined upwards towards the middle of the furnace (1) at an angle with horizontal of 45°.

17. A boiler for using the method according to claim 1, comprising a furnace (1) having a charging opening (5), a first support (7) formed as a first grate (7) with grate apertures, a grate (9) located at a lower level, and ignition air nozzles (15) located above the first support, characterized in that said grate apertures constitute more than 70 percent of the area of the first grate (7), that the ignition air nozzles (15) are located in a wall (2) of the boiler above the charging opening (5) and are directed at the first grate (7), and that the wall (2) above the charging opening (5) is inclined upwards towards the middle of the furnace (1) at an angle with horizontal of 30–60°.

18. A boiler for using the method according to claim 1, comprising a furnace (1) having a charging opening (5), a first support (7) formed as a first grate (7) with grate apertures, a grate (9) located at a lower level, and ignition air nozzles (1 5) located above the first support, characterized in that said grate apertures constitute more than 70 percent of the area of the first grate (7), that the ignition air nozzles (15) are located in a wall (2) of the boiler above the charging opening (5) and are directed at the first grate (7), and that the wall (2) above the charging opening (5) is inclined upwards towards the middle of the furnace (1) at an angle with horizontal of 45°.

* * * * *